US011440006B2

(12) United States Patent
Xu et al.

(10) Patent No.: US 11,440,006 B2
(45) Date of Patent: Sep. 13, 2022

(54) MICROFLUIDIC DETECTION CHIP FOR MULTI-CHANNEL RAPID DETECTION

(71) Applicant: LANSION BIOTECHNOLOGY CO., LTD, Jiangsu (CN)

(72) Inventors: Xingshang Xu, Jiangsu (CN); Jeffery Chen, Jiangsu (CN)

(73) Assignee: LANSION BIOTECHNOLOGY CO., LTD, Jiangsu (CN)

( * ) Notice: Subject to any disclaimer, the term of this patent is extended or adjusted under 35 U.S.C. 154(b) by 218 days.

(21) Appl. No.: 16/770,955

(22) PCT Filed: Jan. 24, 2019

(86) PCT No.: PCT/CN2019/073042
§ 371 (c)(1),
(2) Date: Jun. 9, 2020

(87) PCT Pub. No.: WO2019/237742
PCT Pub. Date: Dec. 19, 2019

(65) Prior Publication Data

US 2021/0086179 A1 Mar. 25, 2021

(30) Foreign Application Priority Data

Jun. 12, 2018 (CN) ..... 201810599700.5

(51) Int. Cl.
*B01L 3/00* (2006.01)

(52) U.S. Cl.
CPC ..... *B01L 3/502715* (2013.01); *B01L 2200/10* (2013.01); *B01L 2300/0645* (2013.01);
(Continued)

(58) Field of Classification Search
CPC .. B01L 3/502715; B01L 3/5027; B01L 3/502; B01L 3/50; B01L 2200/10;
(Continued)

(56) References Cited

U.S. PATENT DOCUMENTS 5,902,731 A * 5/1999 Ouyang ..... G01N 33/64 435/287.7
2007/0158246 A1* 7/2007 Davies ..... G01N 33/4905 210/85

(Continued)

FOREIGN PATENT DOCUMENTS

CN 102841213 12/2012
CN 103755777 4/2014

(Continued)

OTHER PUBLICATIONS

"International Search Report (Form PCT/ISA/210) of PCT/CN2019/073042," dated Apr. 24, 2019, with English translation thereof, pp. 1-5.

*Primary Examiner* — Christine T Mui
(74) *Attorney, Agent, or Firm* — JCIP Global Inc.

(57) ABSTRACT

A microfluidic detection chip for multi-channel rapid detection, including a chip body. A chip sampling port, a plurality of independent detection chambers, and a microfluidic channel are disposed on the chip body, and the chip sampling port is connected to the detection chambers by means of the microfluidic channel. The chip body further includes an electrode. The detection chambers are connected to the electrode. The microfluidic channel includes a main flow channel and a plurality of branching microfluidic channels. A tail end of the main flow channel is divided into the plurality of branching microfluidic channels, and the plurality of branching microfluidic channels are connected to the plurality of independent detection chambers in a one-to-one corresponding manner. And, the other end of the main flow channel is connected to the chip sampling port.

5 Claims, 5 Drawing Sheets

(52) U.S. Cl.
CPC ..... *B01L 2300/0816* (2013.01); *B01L 2300/0864* (2013.01); *B01L 2300/161* (2013.01)

(58) Field of Classification Search
CPC ..... B01L 2300/0645; B01L 2300/0816; B01L 2300/0864; B01L 2300/161
USPC ..... 422/504, 500, 50
See application file for complete search history.

(56) References Cited

U.S. PATENT DOCUMENTS

| | | | | |
|---|---|---|---|---|
| 2008/0297169 | A1* | 12/2008 | Greenquist ..... | G01N 33/86 422/68.1 |
| 2015/0111196 | A1 | 4/2015 | Xia et al. | |

FOREIGN PATENT DOCUMENTS

| | | |
|---|---|---|
| CN | 105289763 | 2/2016 |
| CN | 205361375 | 7/2016 |
| CN | 206701297 | 12/2017 |
| CN | 206756858 | 12/2017 |
| CN | 108745429 | 11/2018 |

* cited by examiner

MICROFLUIDIC DETECTION CHIP FOR MULTI-CHANNEL RAPID DETECTION

CROSS-REFERENCE TO RELATED APPLICATION

This is a 371 application of the International PCT application Ser. No. PCT/CN2019/073042, filed on Jan. 24, 2019, which claims the priority benefits of China Application No. 201810599700.5, filed on Jun. 12, 2018. The entirety of each of the above-mentioned patent applications is hereby incorporated by reference herein and made a part of this specification.

TECHNICAL FIELD

The present invention relates to the technical field of medical devices, and in particular, to a microfluidic detection chip for multi-channel rapid detection.

BACKGROUND

Microfluidics is a technology applied across a variety of disciplines including engineering, physics, chemistry, microtechnology, and biotechnology. Microfluidics involves the study of trace fluids and the study of how to manipulate, control, and use such small amounts of fluids in various microfluidic systems and devices such as microfluidic chips. For example, microfluidic biochips (referred to as "lab-on-chips") are used to integrate test operations in the field of molecular biology for purposes such as analyzing enzymes and DNA, detecting biochemical toxins and pathogens, and diagnosing diseases.

The microfluidic chip is a hot area in the development of current miniaturized total analysis systems. Microfluidic chip analysis takes a chip as an operating platform, analytical chemistry as the basis, micro-electromechanical processing technology as the support, a micro-pipeline network as a structural feature, and life sciences as the main application object at present, and is the focus of the development of the current miniaturized total analysis system field. The microfluidic chip analysis aims at integrating the functions of the entire laboratory, including sampling, dilution, reagent addition, reaction, separation, detection, etc. on the microchip. The microfluidic chip is the main platform for microfluidic technology implementation. Device features of the microfluidic chip are mainly that the effective structures (channels, detection chambers and some other functional components) containing fluids are micron-scale-sized in at least one dimension. Due to the micron-scale structure, the fluid shows and produces special performance different from the macro-scale. As a result, unique analytical performance has been developed. Characteristics and development advantages of the microfluidic chip: the microfluidic chip has the characteristics of controllable liquid flow, minimal consumption of samples and reagents, and ten to hundreds of times improvement in analysis speeds. Simultaneous analysis of hundreds of samples can be performed in minutes or even less, and the entire process of sample pretreatment and analysis can be realized online. The application purpose of the microfluidic chip is to realize the ultimate goal of the miniaturized total analysis systems, i.e., the lab-on-chip. The key application field of current work development is the field of life sciences.

Current international research status: innovations are mostly focused on separation and detection systems, and it is still weak in the study on a number of issues about how to introduce actual samples for analysis on the chip, such as sample introduction, sample change, and pretreatment. The development depends on multidisciplinary development.

Chinese patent document CN205361375U discloses a microfluidic chip, comprising a glass substrate layer, an intermediate layer, and an upper cover layer sequentially stacked from bottom to top. The glass substrate layer, the intermediate layer, and the upper cover layer cooperate to define a closed annular microfluidic channel and detection chambers. The microfluidic channel is located outside the detection chambers and communicated with the detection chambers. A fluid injection port communicated with the microfluidic channel is disposed on one side of the upper cover layer. A plurality of exhaust holes are disposed on the upper cover layer at the other end of the microfluidic channel. However, the above technical solution has small detection throughout, complicated structure and high cost, and is unreasonable in design of a sample inlet, which is likely to cause sample contamination.

Therefore, it is necessary to develop a microfluidic detection chip for multi-channel rapid detection with a reasonably designed sample inlet to avoid sample contamination, large detection throughout, and high detection efficiency and accuracy.

SUMMARY

The technical problem to be solved by the present invention is to provide a microfluidic detection chip for multi-channel rapid detection with a reasonably designed sample inlet to avoid sample contamination, and having large detection throughout, and high detection efficiency and accuracy.

To solve the technical problems above, the present invention adopts the following technical solution: a microfluidic detection chip for multi-channel rapid detection, including a chip body, a chip sampling port, a plurality of independent detection chambers, and a microfluidic channel being disposed on the chip body. The chip sampling port is connected to the detection chambers by means of the microfluidic channel. The chip body further comprises an electrode. The detection chambers are connected to the electrode. The microfluidic channel comprises a main flow channel and a plurality of branching microfluidic channels. A tail end of the main flow channel is divided into the plurality of branching microfluidic channels, and the plurality of branching microfluidic channels are connected to the plurality of independent detection chambers in a one-to-one corresponding manner. The other end of the main flow channel is connected to the chip sampling port.

With the technical solution above, the microfluidic chip has the characteristics of high accuracy, fast speed, and low detection cost in detection, and thus is suitable for performing detection in the links of precision medicine. By designing the main flow channel and the plurality of branching microfluidic channels in a specific structural form to guide the flow of blood samples, one sample chamber may simultaneously inject samples into a plurality of reaction chambers without contaminating the samples, and it is easy to inject samples. After sampled by the chip sampling port, the samples simultaneously flow through the main flow channel to the plurality of branching microfluidic channels, and then flow into the plurality of independent detection chambers, where detection reagents are embedded in advance, so that the plurality of samples may be simultaneously detected, and the multi-channel effect is achieved. The chip is simple in structure and convenient in operation, thereby improving the detection efficiency, greatly reducing the consumption of resources, realizing rapid detection, and lowering the cost.

A further improvement of the present invention is that: the chip body comprises a bottom plate layer, an intermediate layer, and an upper cover layer in sequence from bottom to top. The bottom plate layer, the intermediate layer, and the upper cover layer cooperatively defining a closed microfluidic channel and a plurality of independent detection chambers. The microfluidic channel and the detection chambers are located in the intermediate layer. A liquid injection port and a plurality of exhaust holes are disposed on the upper cover layer, the plurality of exhaust holes are disposed on one side of the upper cover layer corresponding to the tail end of the microfluidic channel, and the liquid injection port is connected a front end of the microfluidic channel. The electrode is provided on the bottom plate layer, and the detection chambers are connected to the electrode. The chip adopting a three-layer structure of the bottom plate layer, the intermediate layer and the upper cover layer has a reasonable design, a simple and compact structure, and reduced cost, and has a chip sampling port for easy injection of samples. A plurality of exhaust holes are disposed on the upper cover, so that the flow resistance of the fluid to be detected is reduced, and the flow is faster, thereby realizing rapid filling of the detection chambers. The provision of the exhaust holes facilitates the flow of the samples and thus the sample injection. If there is no exhaust hole, the sample cannot flow into the detection chamber for reaction. The detection reagents are embedded in the detection chambers of the chip in advance.

A further improvement of the present invention is that: the plurality of independent detection chambers are distributed in a fan shape, and the tail end of the main flow channel is divided into a plurality of branching microfluidic channels, and the plurality of branching microfluidic channels are then connected to the plurality of independent detection chambers. By designing the main flow channel and the plurality of branch microfluidic channels in a specific structural form to guide the flow of blood samples, one sample chamber can simultaneously inject samples into a plurality of reaction chambers, making the flow faster and improving the detection efficiency.

A further improvement of the present invention is that: the chip sampling port is composed of the liquid injection port. The chip sampling port is connected to the main flow channel, a liquid receiving port is disposed on one end of the main flow channel corresponding to the liquid injection port, and the other end of the main flow channel is connected to all the branching microfluidic channels. The chip sampling port with such a structure is easy to sample without contamination, has a simple structure and low cost.

A further improvement of the present invention is that: the bottom plate layer, the intermediate layer, and the upper cover layer cooperatively defining a closed microfluidic channel, detection chambers, and a funnel region. A notch is disposed on one side of a lower end of the bottom plate layer. The liquid injection port, the funnel region, and the notch are respectively disposed at corresponding positions on the upper cover layer, the intermediate layer, and the bottom plate layer and have different sizes. The chip sampling port is composed of the liquid injection port, the funnel region, and the notch and the chip sampling port is connected to the bottom of the detection chambers by means of the microfluidic channel. The chip sampling port is set to a funnel shape with a large bottom plate area, a small upper cover area and a funneled intermediate layer. This structure is reasonable and simple, making the sample easily flow in without being contaminated and improving the detection efficiency.

A further improvement of the present invention is that: the liquid injection port, the funnel region, and the notch are all arc-shaped and having different radians; the liquid injection port and the funnel region are semicircular arc-shaped, and the radius of the funnel region is not less than the arc radius of the liquid injection port; a curved main flow channel in the funnel region is divided into a plurality of branch microfluidic channels which are connected to the plurality of independent detection chambers in a one-to-one corresponding manner; the area of the notch is smaller than the area of the funnel region; or the main flow channel is a funnel region, the liquid injection port is arc-shaped and overlaps with a part of the funnel region, the funnel region is converged inward from an opening to form a horn shape, and the funnel region is inwardly divided into a plurality of branching microfluidic channels at the tail end thereof, and the plurality of branching microfluidic channels are connected to the plurality of independent detection chambers in a one-to-one correspondence manner. Here, the liquid injection port is semicircular arc-shaped. Under the condition of the same area, such a structure provides the largest number of injected samples, and the radius of the funnel region is not less than the arc radius of the liquid injection port, so that the funnel region can fully accommodate the sample liquid injected from the liquid injection port, without loss of the sample. The curved flow channel is provided so that the samples slowly flow into the detection chambers, without causing a sudden increase in the atmospheric pressure of the detection chambers.

Here, the liquid injection port is set to an arc shape, and overlaps with a part of the funnel region; the funnel region is converged inward from an opening to form a horn shape, so that samples gradually flow inward without stopping at the opening, thereby avoiding the loss of the sample. Using such a structure, for example, the speed at which blood samples flow to the sampling port in the funnel region is about 1 second, which realizes rapid suction of the blood samples into the sampling port. The notch is provided for fitting the finger pads to facilitate sampling.

A further improvement of the present invention is that: the bottom plate layer, the intermediate layer, and the upper cover layer are integrally bonded together by means of double-sided gluing of the intermediate layer.

As a preferred technical solution of the present invention, the intermediate layer is a pressure-sensitive adhesive tape, the material of the upper cover layer and/or the bottom plate layer is any one of PMMA, PP, PE and PET, and the surfaces of the upper cover layer and the bottom plate layer each has a hydrophilic membrane, so that the samples flow rapidly through the chip sampling port into the main flow channel, and then are distributed to each of the branching microfluidic channels. With this technical solution, the materials are easily available, and the manufacturing process of the pressure-sensitive adhesive tape may accurately control its thickness. Therefore, with this technical solution, the depth and size of the microfluidic channel may be accurately controlled, and it is also convenient to control the depth of the detection chambers, so that the thickness deviation of the detection chambers of the microfluidic chip is small, the consistency is high, and the accuracy of detection is improved. A hydrophilic membrane is disposed on the surfaces of the upper cover layer and the bottom plate layer, so that the samples flow through the chip sampling port into the main flow channel more rapidly, and are distributed to each branch microfluidic channel, which speeds up the flow rate and improves the detection efficiency.

As a preferred technical solution of the present invention, the thickness of the intermediate layer is 0.1 mm-1.0 mm, the surface of the bottom plate layer is flat, and the depth of the closed microfluidic channel cooperatively defined by the bottom plate layer, the intermediate layer, and the upper cover layer is 0.1 mm-1.0 mm, and the width of the detection chambers cooperatively defined by the bottom plate layer, the intermediate layer, and the upper cover layer is 1.0 mm-2.0 mm.

As a preferred technical solution of the present invention, a nozzle is disposed at the junction of each of the branching microfluidic channels and the corresponding detection chamber, and each of the branching microfluidic channels has a corresponding electrode. Each of the electrode comprises an input high-side electrode and an input low-side electrode, and the thickness of the electrode is 50 μm. Disposing the nozzle at the junction of the branching microfluidic channel and the detection chamber makes the samples flow into the detection chambers more easily and rapidly. The electrode is provided for applying a pulse voltage while receiving a signal generated by the blood reaction in the detection chambers. An electrode tip is inserted into a detection instrument, and a detection result is obtained by detecting an electrochemical signal generated by the reaction in cooperation with the supporting detection instrument. The electrode tip is a part of the integrally bonded bottom plate layer, intermediate layer and upper cover layer that is exposed outside relative to the upper cover layer and the intermediate layer, so that the electrode tip can be inserted into the detection instrument more easily and conveniently.

Compared with the prior art, the microfluidic detection chip for multi-channel rapid detection is designed with a main flow channel and a plurality of branching microfluidic channels in a specific structural form to guide the flow of blood samples, so that one sample chamber may simultaneously inject samples into a plurality of reaction chambers without contaminating the samples, and it is easy to inject samples. After sampled by the chip sampling port, the samples simultaneously flow through the main flow channel to the plurality of branching microfluidic channels, and then flow into the plurality of independent detection chambers. In this way, the plurality of samples may be simultaneously detected, and the multi-channel effect is achieved. The chip is simple in structure and convenient in operation, thereby improving the detection efficiency and accuracy, greatly reducing the consumption of resources, realizing rapid detection, and lowering the cost.

BRIEF DESCRIPTION OF THE DRAWINGS

The detailed description is further provided below with reference to the accompanying drawings and embodiments of the present invention.

DETAILED DESCRIPTION OF THE EMBODIMENT

Figure 1:
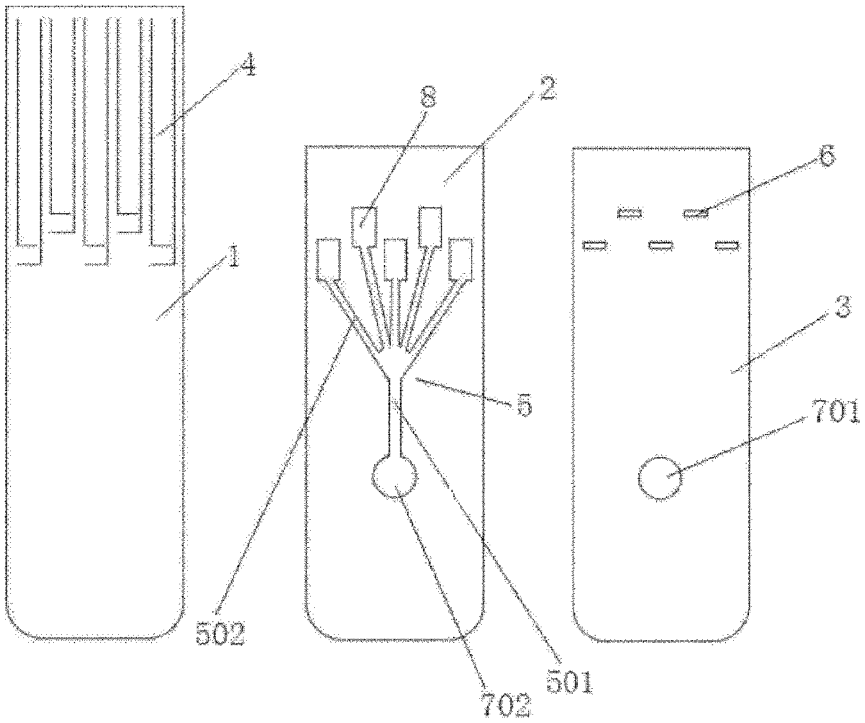
FIG. 1 is a schematic planar structural diagram of Embodiment 1 of a microfluidic detection chip for multi-channel rapid detection according to the present invention.
Figure 2:
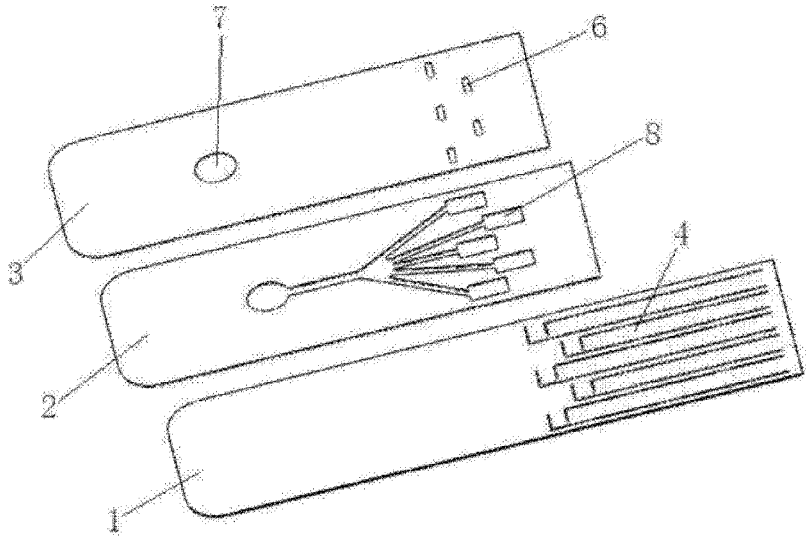
FIG. 2 is a schematic perspective structural diagram of Embodiment 1 of a microfluidic detection chip for multi-channel rapid detection according to the present invention.
Figure 3:
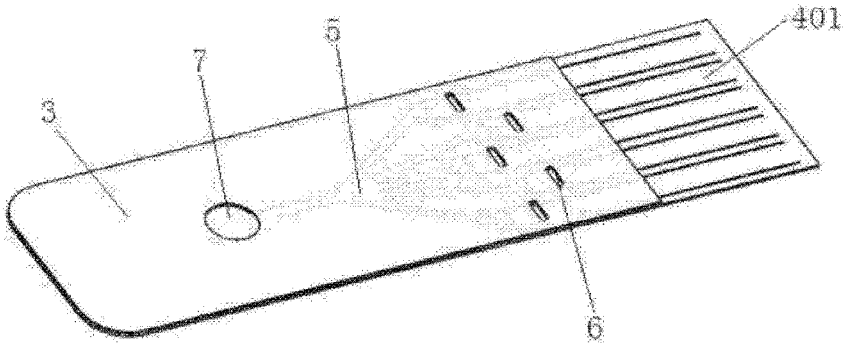
FIG. 3 is an overall structural diagram of Embodiment 1 of a microfluidic detection chip for multi-channel rapid detection according to the present invention.

Embodiment 1: the microfluidic detection chip for multi-channel rapid detection includes a chip body. A chip sampling port 7, a plurality of independent detection chambers 8, and a microfluidic channel 5 are disposed on the chip body. The chip sampling port 7 is connected to the detection chambers 8 by means of the microfluidic channel 5. The chip body further includes an electrode 4. The detection chambers 8 are connected to the electrode 4. The microfluidic channel 5 includes a main flow channel 501 and five branching microfluidic channels 502. A tail end of the main flow channel 501 is divided into five branching microfluidic channels 502, and the five branching microfluidic channels 502 are connected to five independent detection chambers 8 in a one-to-one corresponding manner. The other end of the main flow channel 501 is connected to the chip sampling port 7. The chip body includes a bottom plate layer 1, an intermediate layer 2, and an upper cover layer 3 in sequence from bottom to top. The bottom plate layer 1, the intermediate layer 2, and the upper cover layer 3 cooperatively define a closed microfluidic channel 5 and a plurality of independent detection chambers 8. The microfluidic channel 5 and the detection chambers 8 are located in the intermediate layer 2. A liquid injection port 701 and five exhaust holes 6 are disposed on the upper cover layer 3. The five exhaust holes 6 are disposed on one side of the upper cover layer corresponding to the tail end of the microfluidic channel 5, and the liquid injection port 701 is connected to a front end of the microfluidic channel 5. An electrode 4 is disposed on the bottom plate layer 1, and the detection chambers 8 are connected to the electrode 4. The provision of the exhaust holes 6 is beneficial to the flow of the samples and facilitates the sample injection. If no exhaust hole 6 is disposed, the samples cannot flow into the detection chamber 8 for reaction. Detection reagents are embedded in the detection chambers 8 of the chip in advance. Five independent detection chambers 8 are distributed in a fan shape, and the tail end of the main flow channel 501 is divided into five branching microfluidic channels 502, and the plurality of branching microfluidic channels 502 are then connected to five independent detection chambers 8. The bottom plate layer 1, the intermediate layer 2, and the upper cover layer 3 are integrally bonded together by means of double-sided gluing of the intermediate layer 2. The intermediate layer 2 is a pressure-sensitive adhesive tape. The material of the upper cover layer 3 and/or the bottom plate layer 1 is any one of PMMA, PP, PE and PET, and the surfaces of the upper cover layer 3 and the bottom plate layer 1 each has a hydrophilic membrane, so that the samples flow rapidly through the chip sampling port 7 into the main flow channel 501, and then are distributed to each branching microfluidic channel 502. The thickness of the intermediate layer 2 is 0.1 mm-1.0 mm. The surface of the bottom plate layer 1 is flat. The depth of the closed microfluidic channel 5 cooperatively defined by the bottom plate layer 1, the intermediate layer 2, and the upper cover layer 3 is 0.1 mm-1.0 mm, and the width of the detection chambers 8 cooperatively defined by the bottom plate layer 1, the intermediate layer 2, and the upper cover layer 3 is 1.0 mm-2.0 mm. A nozzle is disposed at the junction of each of the branching microfluidic channels 502 and the corresponding detection chamber 8, and each of the branching microfluidic channels 502 has a corresponding electrode 4. Each electrode 4 comprises an input high-side electrode and an input low-side electrode, and the thickness of the electrode 4 is 50 μm. The electrode 4 is provided for applying a pulse voltage while receiving a signal generated by the blood reaction in the detection chambers. An electrode tip 401 is inserted into a detection instrument, and a detection result is obtained by detecting an electrochemical signal generated by the reaction in cooperation with the supporting detection instrument. The electrode tip 401 is a part of the integrally bonded bottom plate layer 1, intermediate layer 2 and upper cover layer 3 that is exposed outside relative to the upper cover layer 3 and the intermediate layer 2, so that the electrode tip 401 may be inserted into the detection instrument more easily and conveniently, so as to obtain the detection result. As shown in FIG. 1 to FIG. 3, the chip sampling port 7 is a liquid injection port 701 and is connected to the main flow channel 501, a liquid receiving port 702 is disposed on one end of the main flow channel 501 corresponding to the liquid injection port 701, and the other end of the main flow channel 501 is connected to all the branching microfluidic channels 502.

Figure 4:
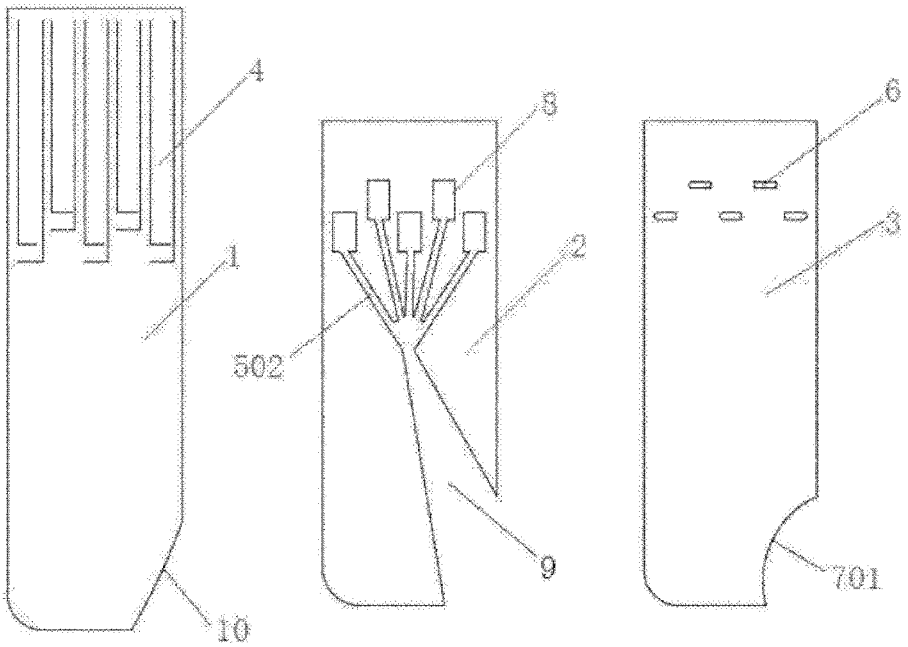
FIG. 4 is a schematic planar structural diagram of Embodiment 2 of a microfluidic detection chip for multi-channel rapid detection according to the present invention.
Figure 5:
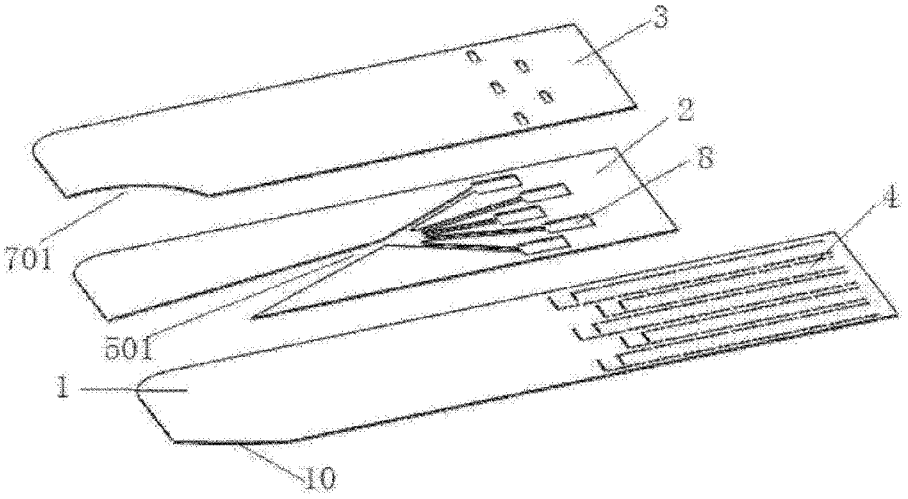
FIG. 5 is a schematic perspective structural diagram of Embodiment 2 of a microfluidic detection chip for multi-channel rapid detection according to the present invention.
Figure 6:
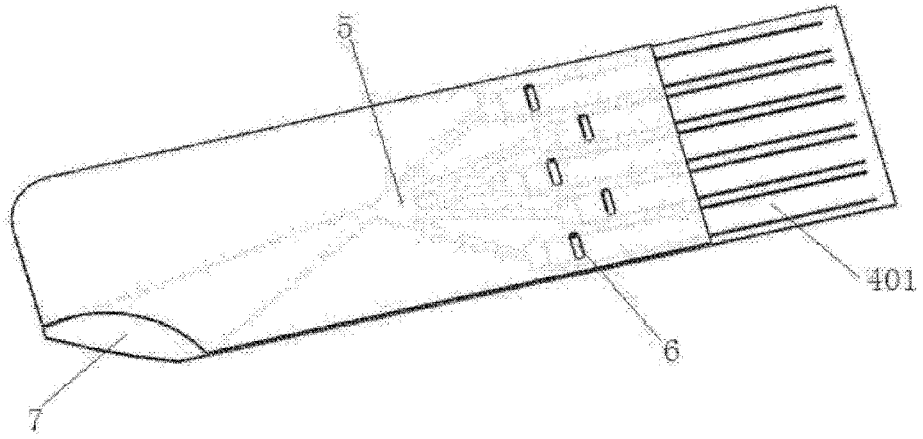
FIG. 6 is an overall structural diagram of Embodiment 2 of a microfluidic detection chip for multi-channel rapid detection according to the present invention.

Embodiment 2: the differences from Embodiment 1 are in that: the structure of the chip sampling port 7 is different, and the bottom plate layer 1, the intermediate layer 2 and the upper cover layer 3 cooperatively defining a closed microfluidic channel 5, detection chambers 8, and a funnel region 9. A notch 10 is disposed on one side of a lower end of the bottom plate layer 1. The liquid injection port 701, the funnel region 9, and the notch 10 are respectively disposed at corresponding positions on the upper cover layer 3, the intermediate layer 2, and the bottom plate layer 1 and have different sizes. The chip sampling port 7 is composed of the liquid injection port 701, the funnel region 9, and the notch 10 and the chip sampling port 7 is connected to the bottom of the detection chambers 8 by means of the microfluidic channel 5. Specifically, the microfluidic detection chip for multi-channel rapid detection includes a chip body. A chip sampling port 7, a plurality of independent detection chambers 8, and a microfluidic channel 5 are disposed on the chip body. The chip sampling port 7 is connected to the detection chambers 8 by means of the microfluidic channel 5. The chip body further includes an electrode 4. The detection chambers 8 are connected to the electrode 4. The microfluidic channel 5 includes a main flow channel 501 and five branching microfluidic channels 502, a tail end of the main flow channel 501 is divided into five branching microfluidic channels 502, and the five branching microfluidic channels 502 are connected to five independent detection chambers 8 in a one-to-one corresponding manner. The other end of the main flow channel 501 is connected to the chip sampling port 7. The chip body includes a bottom plate layer 1, an intermediate layer 2, and an upper cover layer 3 in sequence from bottom to top. The bottom plate layer 1, the intermediate layer 2, and the upper cover layer 3 cooperatively define a closed microfluidic channel 5 and a plurality of independent detection chambers 8. The microfluidic channel 5 and the detection chambers 8 are located in the intermediate layer 2. A liquid injection port 701 and five exhaust holes 6 are disposed on the upper cover layer 3. The five exhaust holes 6 are provided on one side of the upper cover layer corresponding to the tail end of the microfluidic channel 5, and the liquid injection port 701 is connected to a front end of the microfluidic channel 5. An electrode 4 is disposed on the bottom plate layer 1, and the detection chambers 8 are connected to the electrode 4. The provision of the exhaust holes 6 is beneficial to the flow of the samples and facilitates the sample injection. If no exhaust hole 6 is disposed, the samples cannot flow into the detection chamber 8 for reaction. Detection reagents are embedded in the detection chambers 8 of the chip in advance. Five independent detection chambers 8 are distributed in a fan shape, and the tail end of the main flow channel 501 is divided into five branching microfluidic channels 502, and the plurality of branching microfluidic channels 502 are then connected to five independent detection chambers 8. The bottom plate layer 1, the intermediate layer 2, and the upper cover layer 3 are integrally bonded together by means of double-sided gluing of the intermediate layer 2. The intermediate layer 2 is a pressure-sensitive adhesive tape. The material of the upper cover layer 3 and/or the bottom plate layer 1 is any one of PMMA, PP, PE and PET, and the surfaces of the upper cover layer 3 and the bottom plate layer 1 each has a hydrophilic membrane, so that the samples flow rapidly through the chip sampling port 7 into the main flow channel 501, and then are distributed to each branching microfluidic channel 502. The thickness of the intermediate layer 2 is 0.1 mm-1.0 mm. The surface of the bottom plate layer 1 is flat. The depth of the closed microfluidic channel 5 cooperatively defined by the bottom plate layer 1, the intermediate layer 2, and the upper cover layer 3 is 0.1 mm-1.0 mm, and the width of the detection chambers 8 defined is 1.0 mm-2.0 mm. A nozzle is disposed at the junction of each of the branching microfluidic channels 502 and the corresponding detection chamber 8, and each of the branching microfluidic channels 502 has a corresponding electrode 4. Each electrode 4 comprises an input high-side electrode and an input low-side electrode, and the thickness of the electrode 4 is 50 μm. The electrode 4 is provided for applying a pulse voltage while receiving a signal generated by the blood reaction in the detection chambers. An electrode tip 401 is inserted into a detection instrument, and a detection result is obtained by detecting an electrochemical signal generated by the reaction in cooperation with the supporting detection instrument. The electrode tip 401 is a part of the integrally bonded bottom plate layer 1, intermediate layer 2 and upper cover layer 3 that is exposed outside relative to the upper cover layer 3 and the intermediate layer 2, so that the electrode tip 401 may be inserted into the detection instrument more easily and conveniently, so as to obtain the detection result. As shown in FIG. 4 to FIG. 6, the bottom plate layer 1, the intermediate layer 2, and the upper cover layer 3 cooperatively defining a closed microfluidic channel 5, detection chambers 8, and a funnel region 9. A notch 10 is disposed on one side of a lower end of the bottom plate layer 1. The liquid injection port 701, the funnel region 9, and the notch 10 are respectively disposed at corresponding positions on the upper cover layer 3, the intermediate layer 2, and the bottom plate layer 1 and have different sizes. The chip sampling port 7 is composed of the liquid injection port 701, the funnel region 9, and the notch 10 and the chip sampling port 7 is connected to the bottom of the detection chambers 8 by means of the microfluidic channel 5. The main flow channel 501 is the funnel region 9. The liquid injection port 701 is arc-shaped, and overlaps with a part of the funnel region 9. The funnel region 9 is converged inward from an opening to form a horn shape, and the funnel region 9 is inwardly divided into five branching microfluidic channels 502 at the tail end thereof, and the five branching microfluidic channels 502 are connected to the five independent detection chambers 8 in a one-to-one corresponding manner. The liquid injection port 701 is set to an arc shape, and overlaps with a part of the funnel region 9. The funnel region 9 is converged inward from an opening to form a horn shape, so that samples gradually flow inward without stopping at the opening, thereby avoiding sample loss.

Embodiment 3: the differences from Embodiment 1 are in that: the structure of the chip sampling port is different, and the bottom plate layer 1, the intermediate layer 2 and the upper cover layer 3 cooperatively defining a closed microfluidic channel 5, detection chambers 8, and a funnel region 9. A notch 10 is disposed on one side of a lower end of the bottom plate layer 1. The liquid injection port 701, the funnel region 9, and the notch 10 are respectively disposed at corresponding positions on the upper cover layer 3, the intermediate layer 2, and the bottom plate layer 1 and have different sizes. The chip sampling port 7 is composed of the liquid injection port 701, the funnel region 9, and the notch 10 and the chip sampling port 7 is connected to the bottom of the detection chambers 8 by means of the microfluidic channel 5. Specifically, the microfluidic detection chip for multi-channel rapid detection includes a chip body. A chip sampling port 7, a plurality of independent detection chambers 8, and a microfluidic channel 5 are disposed on the chip body. The chip sampling port 7 is connected to the detection chambers 8 by means of the microfluidic channel 5. The chip body further includes an electrode 4. The detection chambers 8 are connected to the electrode 4. The microfluidic channel 5 includes a main flow channel 501 and five branching microfluidic channels 502. A tail end of the main flow channel 501 is divided into five branching microfluidic channels 502, and the five branching microfluidic channels 502 are connected to five independent detection chambers 8 in a one-to-one corresponding manner. The other end of the main flow channel 501 is connected to the chip sampling port 7. The chip body includes a bottom plate layer 1, an intermediate layer 2, and an upper cover layer 3 in sequence from bottom to top. The bottom plate layer 1, the intermediate layer 2, and the upper cover layer 3 cooperatively define a closed microfluidic channel 5 and a plurality of independent detection chambers 8.

Figure 7:
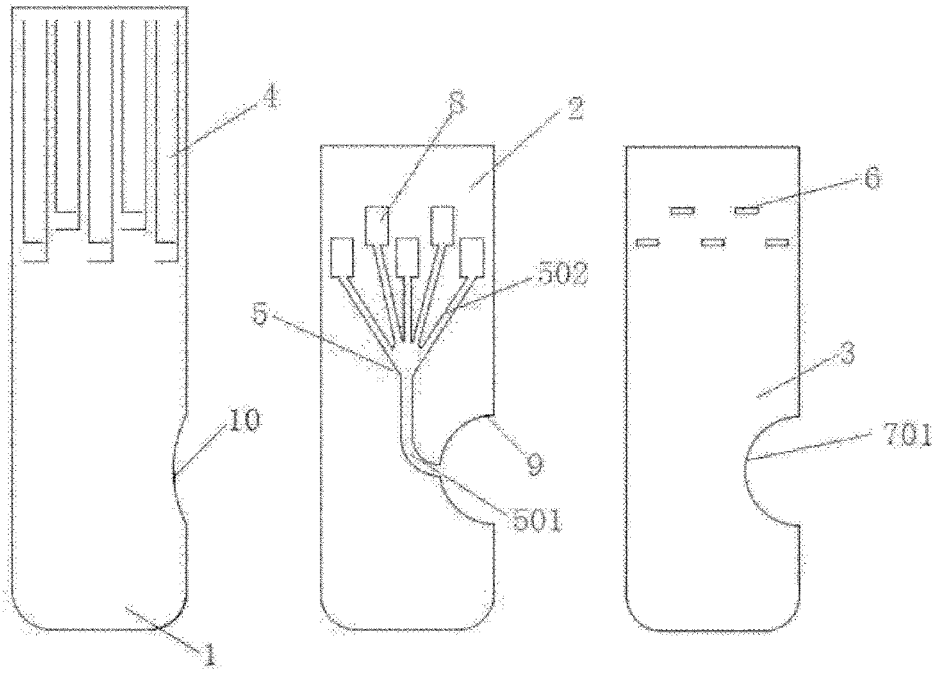
FIG. 7 is a schematic planar structural diagram of Embodiment 3 of a microfluidic detection chip for multi-channel rapid detection according to the present invention.
Figure 8:
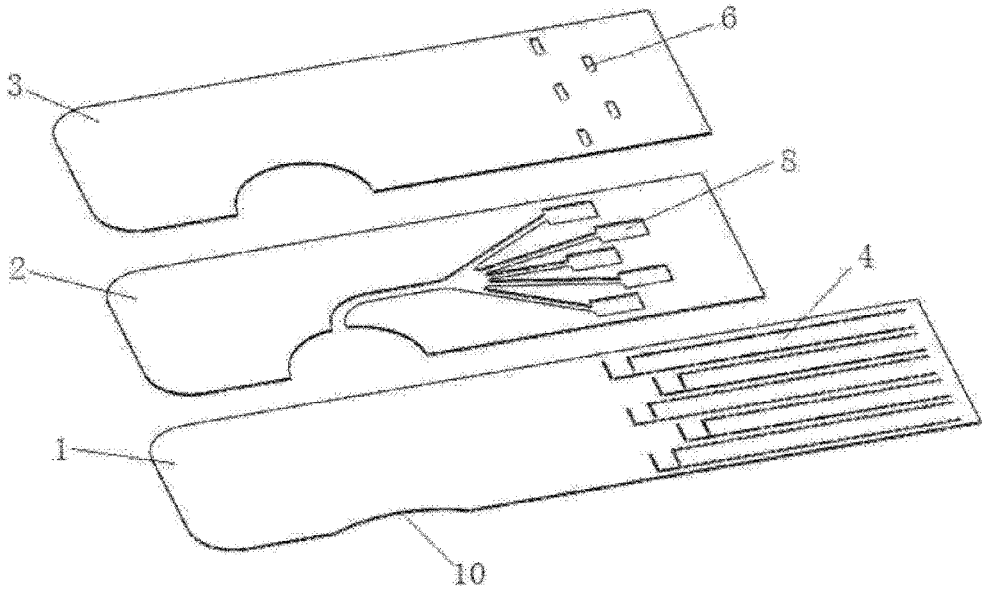
FIG. 8 is a schematic perspective structural diagram of Embodiment 3 of a microfluidic detection chip for multi-channel rapid detection according to the present invention.
Figure 9:
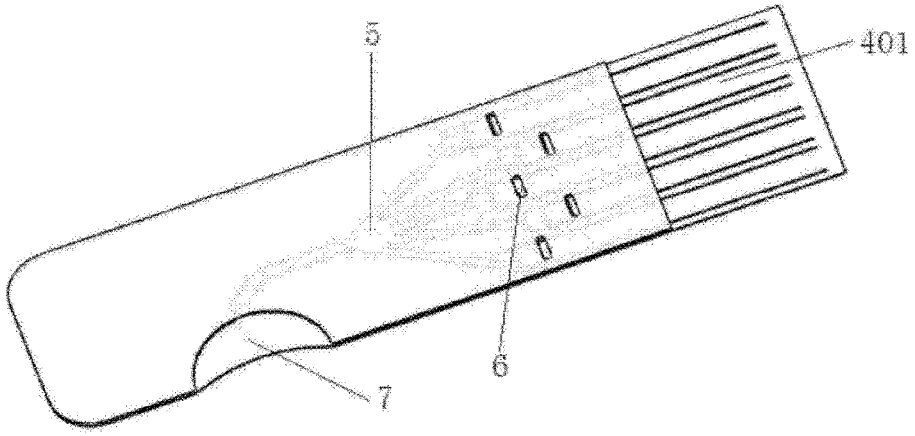
FIG. 9 is an overall structural diagram of Embodiment 3 of a microfluidic detection chip for multi-channel rapid detection according to the present invention.

The microfluidic channel 5 and the detection chambers 8 are located in the intermediate layer 2. A liquid injection port 701 and five exhaust holes 6 are disposed on the upper cover layer 3. The five exhaust holes 6 are disposed on one side of the upper cover layer corresponding to the tail end of the microfluidic channel 5, and the liquid injection port 701 is connected to a front end of the microfluidic channel 5. An electrode 4 is disposed on the bottom plate layer 1, and the detection chambers 8 are connected to the electrode 4. The provision of the exhaust holes 6 is beneficial to the flow of the samples and facilitates the sample injection. If no exhaust hole 6 is provided, the samples cannot flow into the detection chamber 8 for reaction. Detection reagents are embedded in the detection chambers 8 of the chip in advance. Five independent detection chambers 8 are distributed in a fan shape, and the tail end of the main flow channel 501 is divided into five branching microfluidic channels 502, and the plurality of branching microfluidic channels 502 are then connected to five independent detection chambers 8. The bottom plate layer 1, the intermediate layer 2, and the upper cover layer 3 are integrally bonded together by means of double-sided gluing of the intermediate layer 2. The intermediate layer 2 is a pressure-sensitive adhesive tape. The material of the upper cover layer 3 and/or the bottom plate layer 1 is any one of PMMA, PP, PE and PET, and the surfaces of the upper cover layer 3 and the bottom plate layer 1 each has a hydrophilic membrane, so that the samples flow rapidly through the chip sampling port 7 into the main flow channel 501, and then are distributed to each branching microfluidic channel 502. The thickness of the intermediate layer 2 is 0.1 mm-1.0 mm. The surface of the bottom plate layer 1 is flat. The depth of the closed microfluidic channel 5 cooperatively defined by the bottom plate layer 1, the intermediate layer 2, and the upper cover layer 3 is 0.1 mm-1.0 mm, and the width of the detection chambers 8 cooperatively defined by the bottom plate layer 1, the intermediate layer 2, and the upper cover layer 3 is 1.0 mm-2.0 mm. A nozzle is disposed at the junction of each of the branch microfluidic channels 502 and the corresponding detection chamber 8, and each of the branch microfluidic channels 502 has a corresponding electrode 4. Each electrode 4 comprises an input high-side electrode and an input low-side electrode, and the thickness of the electrode 4 is 50 μm. The electrode 4 is provided for applying a pulse voltage while receiving a signal generated by the blood reaction in the detection chambers. An electrode tip 401 is inserted into a detection instrument, and a detection result is obtained by detecting an electrochemical signal generated by the reaction in cooperation with the supporting detection instrument. The electrode tip 401 is a part of the integrally bonded bottom plate layer 1, intermediate layer 2 and upper cover layer 3 that is exposed outside relative to the upper cover layer 3 and the intermediate layer 2, so that the electrode tip 401 may be inserted into the detection instrument more easily and conveniently, so as to obtain the detection result. As shown in FIG. 7 to FIG. 9, the bottom plate layer 1, the intermediate layer 2, and the upper cover layer 3 cooperatively define a closed microfluidic channel 5, detection chambers 8, and a funnel region 9. A notch 10 is disposed on one side of a lower end of the bottom plate layer 1. The liquid injection port 701, the funnel region 9, and the notch 10 are respectively disposed at corresponding positions on the upper cover layer 3, the intermediate layer 2, and the bottom plate layer 1 and have different sizes. The chip sampling port 7 is composed of the liquid injection port 701, the funnel region 9, and the notch 10 and the chip sampling port 7 is connected to the bottom of the detection chambers 8 by means of the microfluidic channel 5. The liquid injection port 701, the funnel region 9, and the notch 10 are all arc-shaped and have different radians. The liquid injection port 701 and the funnel region 9 are semicircular arc-shaped, and the radius of the funnel region 9 is not less than the arc radius of the liquid injection port 701. A curved main flow channel 501 in the funnel region 9 is divided into five branching microfluidic channels 502 which are connected to the five independent detection chambers 8 in a one-to-one corresponding manner. The area of the notch 10 is smaller than the area of the funnel region 9. Here, the liquid injection port 701 is semicircular arc-shaped. Under the condition of the same area, such a structure provides the largest number of injected samples, and the radius of the funnel region 9 is not less than the arc radius of the liquid injection port 701, so that the funnel region 9 may fully accommodate the sample liquid injected from the liquid injection port, without sample loss. The curved flow channel is provided so that the samples slowly flow into the detection chambers 8, without causing a sudden increase in the atmospheric pressure of the detection chambers 8.

In specific use:

Samples are injected into the chip sampling port 7, and simultaneously flow through the main flow channel 501 to the plurality of branching microfluidic channels 502, and then flow into the plurality of independent detection chambers 8. The samples are reacted with the detection reagents pre-embedded in the detection chambers 8, and the microfluidic detection chip for multi-channel rapid detection is inserted into the detection instrument by means of the electrode tip 401. The detection result is obtained by detecting the electrochemical signal generated by the reaction in cooperation with the supporting detection instrument. In this way, the plurality of samples can be simultaneously detected, and the multi-channel effect is achieved, thereby improving the detection efficiency.

The basic principles, main features and advantages of the present invention are shown and described above. Those skilled in the art should understand that the present invention is not limited to the foregoing embodiments. The foregoing embodiments and description merely illustrate the principles of the present invention. Various changes and improvements, such as some other slight adjustments of the shape and structure of the chip sampling port, can also be made to the present invention, without departing from the spirit and scope of the present invention. These changes and improvements fall within the protection scope of the present invention. The protection scope of the present invention is defined by the appended claims and equivalents thereof.

What is claimed is:

1. A microfluidic detection chip for multi-channel rapid detection, comprising a chip body, a chip sampling port, a plurality of independent detection chambers, and a microfluidic channel being disposed on the chip body, the chip sampling port being connected to the detection chambers by means of the microfluidic channel, wherein the chip body further comprises an electrode, and the detection chambers are connected to the electrode; the microfluidic channel comprises a main flow channel and a plurality of branching microfluidic channels, a tail end of the main flow channel is divided into the plurality of branching microfluidic channels, and the plurality of branching microfluidic channels are connected to the plurality of independent detection chambers in a one-to-one corresponding manner; and the other end of the main flow channel is connected to the chip sampling port, wherein the chip body comprises a bottom plate layer, an intermediate layer, and an upper cover layer in sequence from bottom to top, the bottom plate layer, the intermediate layer, and the upper cover layer cooperatively defining a closed microfluidic channel and the plurality of independent detection chambers; the microfluidic channel and the detection chambers are located in the intermediate layer; a liquid injection port and a plurality of exhaust holes are disposed on the upper cover layer, the plurality of exhaust holes are disposed on one side of the upper cover layer corresponding to a tail end of the microfluidic channel, and the liquid injection port is connected to a front end of the microfluidic channel; and the electrode is disposed on the bottom plate layer, wherein the plurality of independent detection chambers are distributed in a fan shape, and the tail end of the main flow channel is divided into the plurality of branching microfluidic channels, and the plurality of branching microfluidic channels are then connected to the plurality of independent detection chambers, wherein the chip sampling port is composed of the liquid injection port; the chip sampling port is connected to the main flow channel, and a liquid receiving port is disposed on one end of the main flow channel corresponding to the liquid injection port; and the other end of the main flow channel is connected to all of the branching microfluidic channels, wherein the liquid injection port, a funnel region, and a notch are all arc-shaped and having different radians; the liquid injection port and the funnel region are semicircular arc-shaped, and a radius of the funnel region is not less than an arc radius of the liquid injection port; a curved main flow channel in the funnel region is divided into the plurality of branching microfluidic channels which are connected to the plurality of independent detection chambers in a one-to-one corresponding manner; and an area of the notch is smaller than an area of the funnel region; or the main flow channel is the funnel region; the liquid injection port is arc-shaped, and overlaps with a part of the funnel region; the funnel region is converged inward from an opening to form a horn shape, so that samples gradually flow inward without stopping at the opening, thereby avoiding loss of the samples; and the funnel region is inwardly divided into the plurality of branching microfluidic channels at the tail end thereof, and the plurality of branching microfluidic channels are connected to the plurality of independent detection chambers in a one-to-one correspondence manner.

2. The microfluidic detection chip for multi-channel rapid detection according to claim 1, wherein the bottom plate layer, the intermediate layer, and the upper cover layer are integrally bonded together by means of double-sided gluing of the intermediate layer.

3. The microfluidic detection chip for multi-channel rapid detection according to claim 1, wherein the intermediate layer is a pressure-sensitive adhesive tape; a material of the upper cover layer and/or the bottom plate layer is any one of PMMA, PP, PE, and PET; and surfaces of the upper cover layer and the bottom plate layer each has a hydrophilic membrane, so that the samples flow rapidly through the chip sampling port into the main flow channel, and then are distributed to each of the branching microfluidic channels.

4. The microfluidic detection chip for multi-channel rapid detection according to claim 3, wherein a thickness of the intermediate layer is 0.1 mm-1.0 mm; the surface of the bottom plate layer is flat; a depth of the closed microfluidic channel cooperatively defined by the bottom plate layer, the intermediate layer, and the upper cover layer is 0.1 mm-1.0 mm and a width of the detection chambers cooperatively defined by the bottom plate layer, the intermediate layer, and the upper cover layer is 1.0 mm-2.0 mm.

5. The microfluidic detection chip for multi-channel rapid detection according to claim 3, wherein a nozzle is disposed at a junction of each of the branching microfluidic channels and the corresponding detection chamber, and each of the branching microfluidic channels has the corresponding electrode; each of the electrode comprises an input high-side electrode and an input low-side electrode, and the thickness of the electrode is 50 μm.

* * * * *